US006564801B1

(12) United States Patent
Frank

(10) Patent No.: US 6,564,801 B1
(45) Date of Patent: May 20, 2003

(54) MEDICAL DEVICE FOR PERFORMING SPINALS OR EPIDURALS

(76) Inventor: Simon Jacob Frank, 11400 SW. 94 Ave., Miami, FL (US) 33176

( * ) Notice: Subject to any disclaimer, the term of this patent is extended or adjusted under 35 U.S.C. 154(b) by 0 days.

(21) Appl. No.: 09/528,847

(22) Filed: Mar. 20, 2000

(51) Int. Cl.[7] ..... A61G 15/00
(52) U.S. Cl. ..... 128/845; 5/630
(58) Field of Search ..... 128/845, 846, 128/869, 820; 5/630, 640, 641, 642, 643; 297/284

(56) References Cited

U.S. PATENT DOCUMENTS 1,354,046 A * 9/1920 Lanning
1,667,626 A * 4/1928 Epstein
3,664,466 A * 5/1972 Rotheiser ..... 188/32
3,829,079 A 8/1974 Fox
3,984,093 A 10/1976 Pretlow
4,660,552 A 4/1987 Latham
4,780,921 A * 11/1988 Lahn ..... 5/437
5,011,203 A * 4/1991 Tackett ..... 292/343
5,357,982 A 10/1994 Shaw
6,125,851 A * 10/2000 Walker ..... 128/845

* cited by examiner

*Primary Examiner*—Michael A. Brown
(74) *Attorney, Agent, or Firm*—Ruben Alcoba; Laurence Edson; Alcoba Edson, P.A.

(57) ABSTRACT

A medical device for positioning a patient correctly in the sitting position when performing spinals or epidurals. The medical device is wedge shaped and inflexible. The device can have handles adjacent to the front wall of the wedge or can be used without the handles.

The device is used by first placing it on an elevated surface, then having a patient sit on the device so that the patient's knees flex at the front and upper juncture of the device. The patient is then instructed to sit upright. By sitting upright, the pelvis will rotate backwards thereby promoting flexion of the lumbar/thoracic spine. On the medical device with handles, the flexion of the lumbar/thoracic spine can be augmented by having the patient push upward, palms up, on the handles. The upward pushing forces will force the lumbar spine posteriorly and further increase thoracic/lumbar flexion. Then either inserting the tip of a spinal needle into the patient's spinal space or inserting the tip of an epidural needle into the patient's epidural space.

4 Claims, 3 Drawing Sheets

MEDICAL DEVICE FOR PERFORMING SPINALS OR EPIDURALS

BACKGROUND

This is the first restraint free medical device for correctly positioning a patient in the sitting position for the purpose of performing spinals or epidurals. This device promotes flexion of the lumbar/thoracic spine while in the sitting position. When the patient sits on the medical device, the knees are raised upwards, the patient's pelvis rotates backwards, and this in turn will promote flexion of the lumbar/thoracic spine. When the lumbar/thoracic spine flexes the intervertebral space is enlarged, this enlargement facilitates the passage of the tip of a hollow needle between the vertebrae.

An epidural procedure requires placing the tip of a hollow needle (an epidural needle) in the epidural space. A spinal procedure requires placing the tip of a hollow needle (a spinal needle) in the subarachnoid space. In either procedure the needle must pass through a narrow space between the vertebra (the intervertebral passage) into the epidural or subarachnoid space. The purpose of the invention in either of these procedures is to facilitate the procedures, to reduce the number of attempts required to insert the needles thereby reducing the patient's discomfort and the time spent performing these procedures, and to reduce the number of attempted procedures that are abandoned after multiple failed attempts to insert the needles.

Information relevant to attempts to address these problems can be found in U.S. Pat. Nos. 3,829,079, 3,984,093, 4,660,552, and 5,357,982. However, each one of these references which are primarily restraining devices to control the incooperative patient, suffers from the disadvantage that the patient has to be forcibly restrained by the straps and pads. In addition, these devices do not produce the optimally flexed and aligned back needed to facilitate the procedures. Furthermore, U.S. Pat. Nos. 3,829,079 and 5,357,982 are intended to be used with the patient lying in the lateral position.

For the above reasons, there is a need for this medical device for performing Spinals or Epidurals, for the cooperative patient in the sitting position, who does not need to be restrained. Furthermore, this device can be inexpensively manufactured and is easy to use.

SUMMARY

The present invention is directed to a medical device, without restraints, that aids in positioning a patient correctly in the sitting position when performing a spinal or an epidural. The medical device comprises of a wedge like structure in which the front wall must have a greater height than the rear wall and the height differential must create an incline between the front wall and the rear wall from about two degrees to about thirty five degrees, and in which all walls of the medical device are made of an inflexible material. The medical device can further comprise of a tube like structure inserted through the wedge like device adjacent to the front wall, wherein said tube like structure is at least four inches greater in width than the front wall. The wedge like device is used by placing the device on an elevated surface and then instructing the patient to sit on the device. The patient will sit on the device with the patients knees flexing at the juncture between the front wall and the top wall of the wedge like device. To maximize the benefit of the device, the patient is instructed to push upward on the handles created by the tube. The angle created by the wedge like device promotes flexion of the lumbar/thoracic spine without restraining the patient.

DRAWINGS

Those and other features, aspects, and advantages of the present invention will become better understood with regard to the following descriptions, appended claims, and accompanying drawings where:

DESCRIPTION

Figure 1:
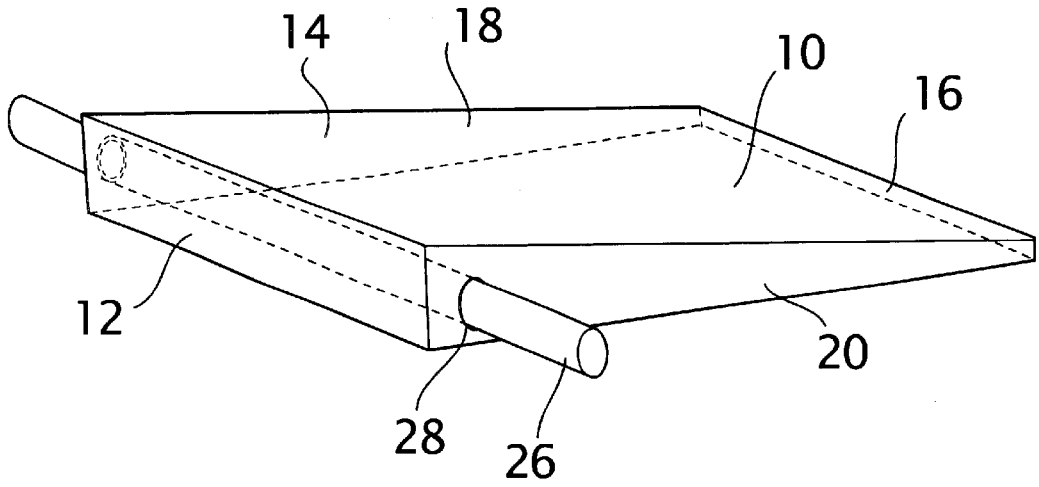
FIG. 1 shows a perspective view of a medical device for correctly positioning a patient in the sitting position for the purpose of performing a spinal or an epidural.
Figure 2:
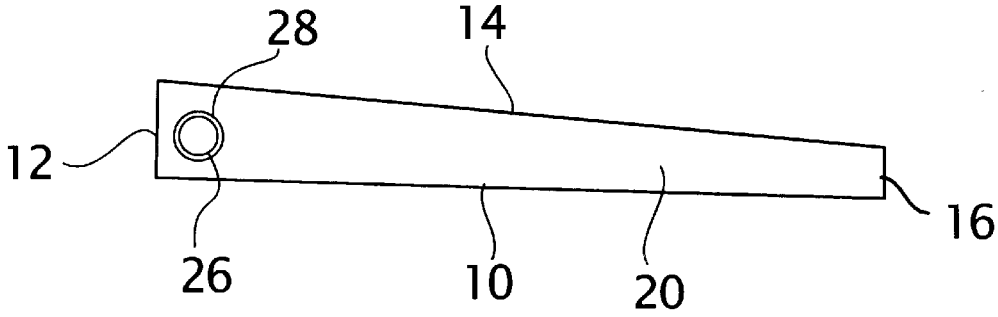
FIG. 2 shows a side elevation view of FIG. 1.
Figure 3:
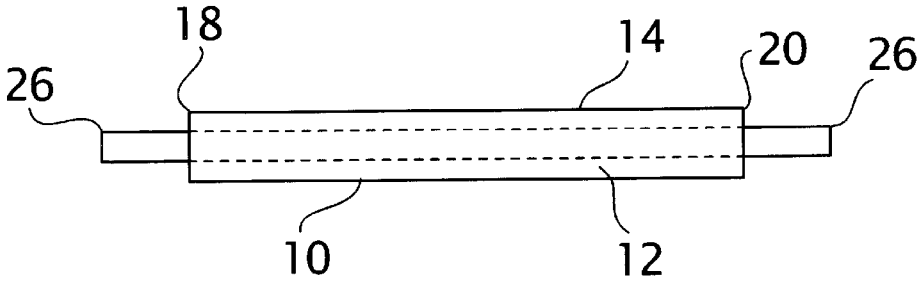
FIG. 3 shows a front plan view of FIG. 1.

As shown in FIG. 1, a medical device for correctly positioning a patient in the sitting position for the purpose of performing a spinal or an epidural comprising of a wedge device formed by attaching a substantially flat bottom wall 10 to a front wall 12 at a perpendicular angle, said front wall 12 being attached to a substantially flat top wall 14, said top wall 14 being attached to a rear wall 16, said rear wall 16 attaching to the bottom wall 10 at a perpendicular angle. The front wall 12 of the wedge device having a greater height than the rear wall 16, and the height differential will create an incline between the front wall 12 and the rear wall 16 from about two degrees to about thirty five degrees. A left wall 18 and a right wall 20 may be attached to the left and right sides of the above wedge device and shaped to fit the aperture created when connecting the bottom 10, front 12, top 14, and rear walls 16 together. The above mentioned walls must be made of an inflexible material.

Figure 5:
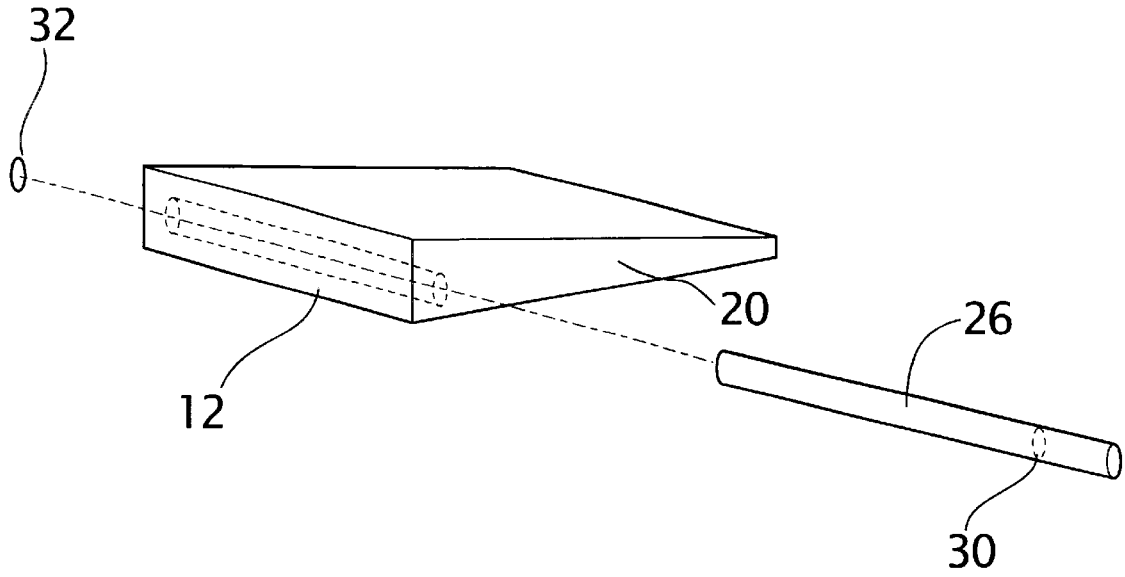
FIG. 5 shows a perspective view of yet another embodiment of a medical device for correctly positioning a patient in the sitting position for the purpose of performing a spinal or an epidural.

In another embodiment of the invention, the left wall 18 and right wall 20 will have a diametrically positioned opening at a location adjacent to the front wall. The openings will allow either the attachment of a left peg 22 or a right peg 24 to the left wall 18 and right wall 20 respectively or the insertion of a housing 28 to traverse between the left wall 18 and the right wall 20, and said housing 28 being attached to said left wall 18 and right wall 20. If the embodiment is the one having the housing 28, then a tube 26 would be inserted inside of said housing 28 and placed to rest equal distance from the left wall 18 and right wall 20. The tube 26 must be at least four inches greater in width than the front wall 12. In another embodiment of the invention, as shown in FIG. 5, a fixed gasket 30 can be attached to the tube 26 wherein the tube after insertion will have an equal distance from the left wall 18 and the right wall 20. An adjustable gasket 32 can be placed on the opposite side of the tube 26 with the fixed gasket 30 to secure it in place.

The above walls will be attached by any of the following means: bonding, gluing, bracketing, nailing, or screwing the walls together. The housing will be attached to the left and right walls by either bonding or gluing.

Figure 4:
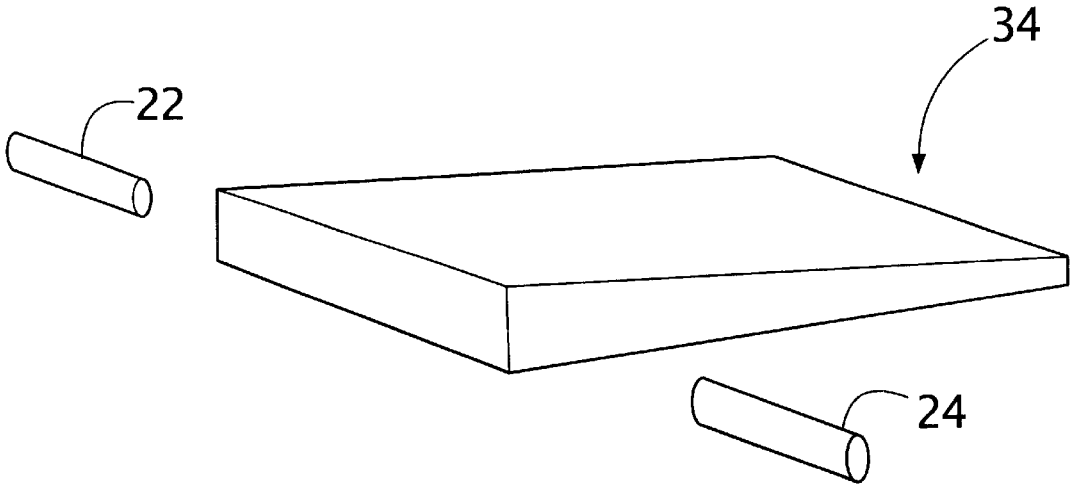
FIG. 4 shows a perspective view of another embodiment of a medical device for correctly positioning a patient in the sitting position for the purpose of performing a spinal or an epidural.

A further embodiment of the invention, as shown in FIG. 4, can be a six sided solid structure 34 which is inflexible and in which the front wall of the solid structure has a greatest height than the rear wall of the solid structure with the remaining opposite sides of the solid structure being of equal dimensions, the height differential between the front wall and the rear wall must create an incline from about two degrees to about thirty five degrees. This solid structure embodiment can further have a left peg 22 and a right peg 24 attached to the left and the right sides of the solid structure respectively and said pegs being diametrically opposed and positioned adjacent to the front wall. The left and right pegs can be attached to the solid structure by gluing, bonding or screwing the pegs to the structure.

The invention is used by placing the medical device on an elevated surface, e.g. a bed or a desk. Instructing a patient to sit on the medical device so that the patient's knees bend at the juncture of the top and front wall. Then having the patient sit on the device. When the patient sits on the device the pelvis will rotate backwards, and this in turn will promote flexion of the lumbar/thoracic spine. The flexion of the lumbar/thoracic spine can be augmented by having the patient push upward, palms up, on the handles of the second embodiment of the invention. The upward pushing forces will force the lumbar spine posteriorly and further increase thoracic/lumbar flexion. Then the administrator of the procedure will either insert the tip of a spinal needle into the patient's spinal space or insert the tip of an epidural needle into the patient's epidural space.

The medical device correctly aligns and optimally flexes the back of a seated patient. The distance between the knees and the shoulders is reduced. The knees are raised and the pelvis rotates posteriorly. In order to maintain balance and not fall backwards, the patient flexes the back and drops the shoulders and the head towards the knees. Pushing up with both hands placed palms up under the pegs or handles, depending on the embodiment of the invention, further forces the shoulders closer to the knees and further enhances flexion of the back. Pushing up with the palms of the hands on the pegs or handles prevents malalignment of the back caused by twisting the back or leaning sideways. Pushing up with the hands placed under the pegs or handles may assist the cooperative patient from making sudden jerking movements.

This medical device is the first invention to correctly align the spine of a child or an adult patient in the sitting position when performing a spinal or an epidural procedure that does not require restraints to secure the patient in place. Other inventions are described as restraining devices aimed at preventing jerking movements in the uncontrolled patient and correct alignment is second in importance to restraint. Straps and pads are used to lock the patient into position. These devices are rarely seen, as most adults would object to being thus restrained, children would be terrified and physicians would prefer to struggle than use such cumbersome machines. This device is meant to be used on patients that will cooperate with the procedure.

Presently, the procedure is done by having a patient sit on the edge of a bed. The present procedure has inherent disadvantages such as the sagging or tilting of the bed which in turn causes the back to move out of alignment. The loss of alignment can result in the extension of the back, sideways flexion of the back, rotation of the back. This malalignment of the spine narrows or obliterates the intervertebral passage and makes performing a spinal or an epidural difficult or impossible, the reason being that the needle encounters bone which blocks the needle's further passage.

Correct alignment is critical to perform a successful spinal or epidural. Correct alignment consists primarily of flexing the back. When the back is flexed, the distance between the knees and the shoulders is reduced, the back is rounded backwards and the belly button is pulled backwards. Correct alignment is essential and optimal alignment greatly facilitates performance of spinals and epidurals.

Spinals and epidurals are common medical procedures performed for diagnostic and therapeutic purposes by anesthesiologists, CRNAs, radiologists, pediatricians, internists, emergency room doctors and other medical personnel.

Although the present invention has been described in considerable detail with reference to certain preferred versions thereof, other versions are possible. Therefore, the spirit and scope of the appended claims should not be limited to the description of the preferred versions contained herein.

What is claimed is:

1. A method of performing a spinal on a patient while the patient is in the sitting position comprising:

a. placing an inflexible wedge device, which has a left and a right handle located at the anterior section of the wedge device, on an elevated surface;

b. sitting the patient on the wedge device so that the knees of the patient flex at the high end of the wedge device;

c. instructing the patient to push upwardly on the said handles;

d. having patient push upwardly on said handles; and e. inserting the tip of a spinal needle into the patient's spinal space.

2. A method of performing an epidural on a patient while the patient is in the sitting position comprising:

a. placing an inflexible wedge device, which has a left and a right handle located at the anterior section of the wedge device, on an elevated surface;

b. sitting the patient on the wedge device so that the knees of the patient flex at the high end of the wedge device;

c. instructing the patient to push upwardly on the said handles;

d. having patient push upwardly on said handles; and e. inserting the tip of an epidural needle into the patient's epidural space.

3. A medical device for positioning a patient in the sitting position for performing spinals or epidurals comprising:

a. a substantially flat bottom wall;

b. A front wall attached to the bottom wall at a perpendicular angle;

c. a substantially flat top wall attached to the front wall;

d. a rear wall attached to the top wall, and in which the rear wall is further attached to the bottom wall, when in the rear wall and the bottom wall are perpendicular to each other;

e. a left wall which is attached to the left side walls of the bottom, front, top, and rear walls;

f. a right wall which is attached to the right side walls of the bottom, front, top, and rear walls;

g. the front wall having a greater height than the rear wall, and the height differential must create an incline between the front and rear wall from about two degrees to about thirty-five degrees;

h. wherein all the walls of the medical device are made of an inflexible material; and i. wherein the left and right side walls have a diametrically opposed opening adjacent to the front wall further comprising a housing inserted into the openings of the left and the right walls, wherein said housing is attached to the left and right walls; and j. a tube inserted into the housing wherein said tube is at least 4 inches greater in width than the front wall and said ends of tube are an equal distance from the left and right walls.

4. The medical device of claim 3 further comprising a gasket fixed at a position of said tube wherein the tube after insertion has an equal distance from the left and right wall.

* * * * *